US006623277B1

(12) United States Patent
Zhu et al.

(10) Patent No.: US 6,623,277 B1
(45) Date of Patent: Sep. 23, 2003

(54) POWER CONNECTOR

(75) Inventors: ZiQiang Zhu, Kunsan (CN); Jinkui Hu, Kunsan (CN); Qijun Zhao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/144,157

(22) Filed: May 10, 2002

(30) Foreign Application Priority Data

Apr. 30, 2002 (TW) ..... 91205990

(51) Int. Cl.[7] ..... H01R 12/20
(52) U.S. Cl. ..... 439/63; 439/80
(58) Field of Search ..... 439/63, 79, 607, 439/609, 80, 578–585

(56) References Cited

U.S. PATENT DOCUMENTS 3,836,946 A * 9/1974 Geiger ..... 439/580
4,255,011 A * 3/1981 Davis et al. ..... 439/580
4,307,926 A * 12/1981 Smith ..... 439/580
4,702,707 A * 10/1987 Hillbish ..... 439/80
5,376,012 A * 12/1994 Clark ..... 439/80
5,547,400 A * 8/1996 Wright ..... 439/63
5,676,565 A * 10/1997 Vagnoni ..... 439/580
5,759,069 A * 6/1998 Kitatani et al. ..... 439/580
6,042,394 A * 3/2000 Mitra et al. ..... 439/80
6,190,215 B1 * 2/2001 Pendleton et al. ..... 439/80

* cited by examiner

*Primary Examiner*—Gary Paumen
(74) *Attorney, Agent, or Firm*—Wei Te Chung

(57) ABSTRACT

A power connector includes an insulative housing, a set of conductive first contacts and a set of conductive second contacts. The insulative housing includes a receiving space defined inwardly from a front surface of the insulative housing and an inner portion extending from a rear wall of the housing and bounded on its sides by the receiving space. The set of conductive first contacts includes first mating contacts and a first soldering contact, the first mating contacts assembled in the inner portion and partly exposed in the receiving space, the first soldering portion assembled into the housing and electrically contacting the first mating contacts. The set of conductive second contacts includes second mating contacts and a second soldering contact, the second mating contacts assembled in the insulative housing and partly exposed in the receiving space, the second soldering contact inserted into the insulative housing and electrically contacting the second mating contacts.

25 Claims, 9 Drawing Sheets

POWER CONNECTOR

BACKGROUND OF THE INVENTION

1. Field of the Invention

The present invention relates to a power connector, and particularly to a power connector having multi-piece contact sets, each contact set comprising separately manufactured mating contacts and soldering contacts.

2. Description of Related Art

Power connectors which have an inner contact and an outer contact are widely used in the field of electronics. The inner contact and the outer contact respectively act as a positive pole and a negative pole of a power supply for providing voltage to electrical components connecting to the power connector. Each contact of the power connector usually has an integral mating portion and soldering portion, and is stamped as one unit from a blank of conductive material. Such prior art contacts are disclosed in Taiwan patent No. 449135, and U.S. Pat. Nos. 4,702,707; 5,376,012; and 6,190,215. U.S. Pat. No. 6,190,215 discloses a contact which mates with a male pin contact of any desired length. Mating portions of the contact are beam-shaped and are integrally stamped with soldering portions from a blank. Latch tabs are formed on the mating portions to prevent the contact from disengaging from a connector housing. However, the contact disclosed in U.S. Pat. No. 6,190,215 comprises a relatively large amount of conductive material. Furthermore, the structure of the contact is relatively complicated, and thus will require a relatively expensive die. The cost of the contact, therefore, is likely to be relatively expensive.

Hence, a power connector having improved contacts is desired to overcome the disadvantages of the prior art.

SUMMARY OF THE INVENTION

Accordingly, an object of the present invention is to provide a power connector having contacts of a simple design.

A second object of the present invention is to provide a power connector which is lower cost.

A power connector comprises an insulative housing, a set of conductive first contacts and a set of conductive second contacts. The insulative housing comprises a receiving space defined inwardly from a front surface of the insulative housing and an inner portion extending from a rear wall of the housing and bounded on its sides by the receiving space. The set of conductive first contacts comprises a plurality of first mating contacts and a first soldering contact, the first mating contacts assembled in the inner portion and partly exposed in the receiving space, the first soldering portion assembled into the housing and electrically contacting the first mating contacts. The set of conductive second contacts comprises a plurality of second mating contacts and a second soldering contact, the second mating contacts assembled in the insulative housing and partly exposed in the receiving space, the second soldering contact inserted into the insulative housing and electrically contacting the second mating contacts.

Other objects, advantages and novel features of the invention will become more apparent from the following detailed description when taken in conjunction with the accompanying drawings.

DETAILED DESCRIPTION OF THE INVENTION

Figure 1:
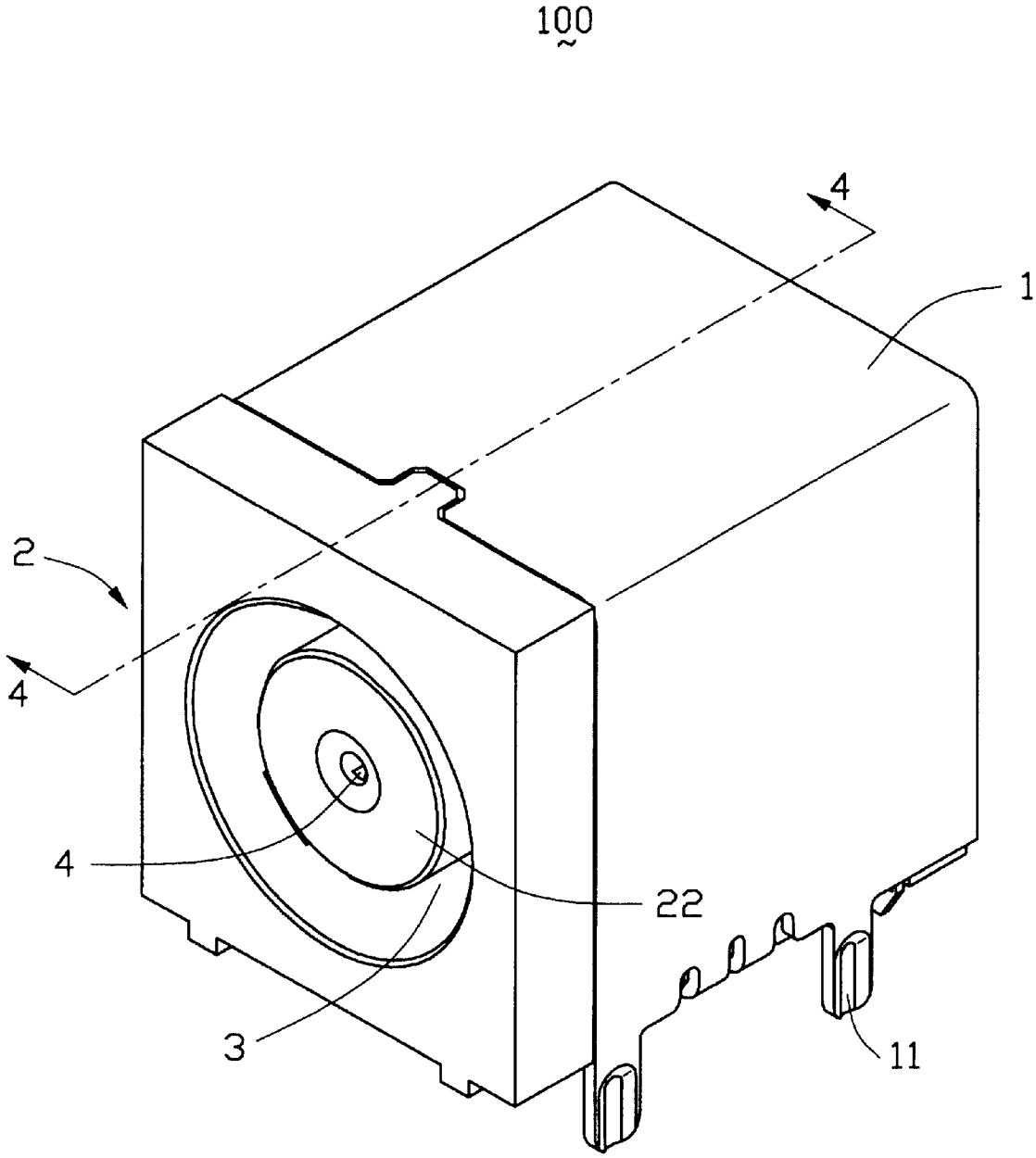
FIG. 1 is a perspective, assembled view of a power connector in accordance with the present invention.
Figure 2:
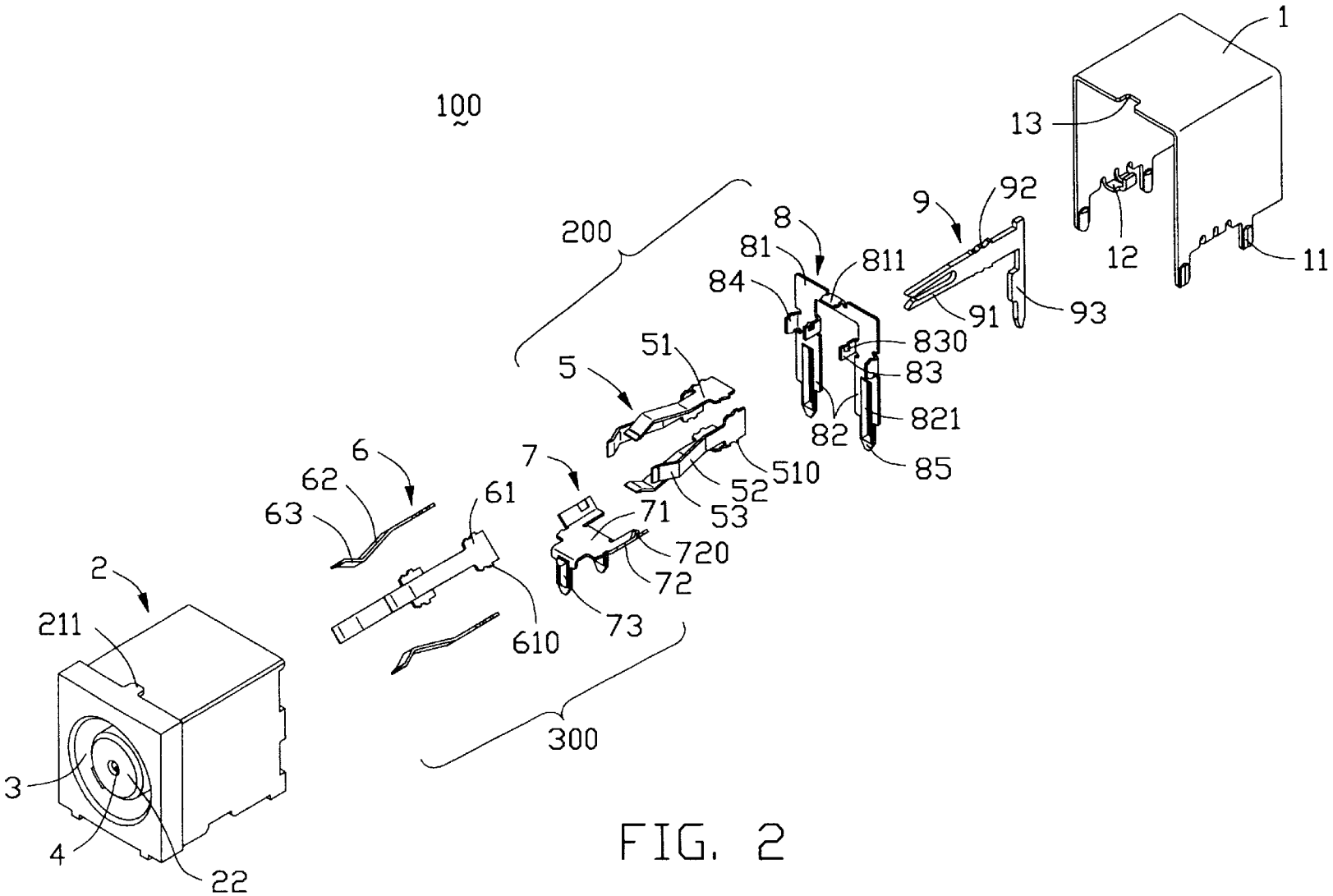
FIG. 2 is an exploded view of the power connector of FIG. 1.
Figure 3:
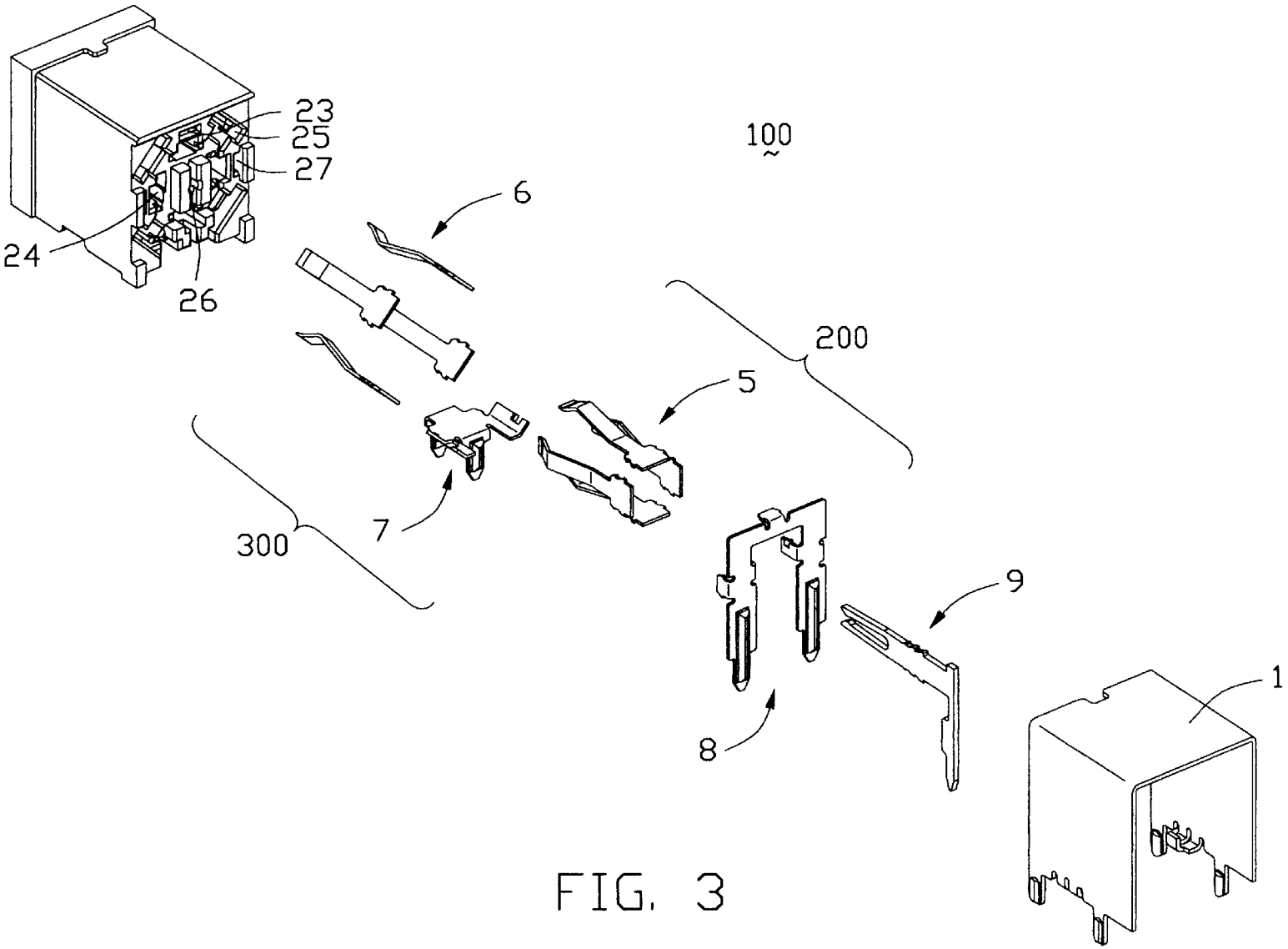
FIG. 3 is a reverse angle view of FIG. 2.

Referring to FIGS. 1 to 3, a power connector 100 of the present invention comprises an insulative housing 2, a set of conductive first contacts 200, a set of conductive second contacts 300, a conductive signal pin 9 and a conductive shield 1.

Figure 9:
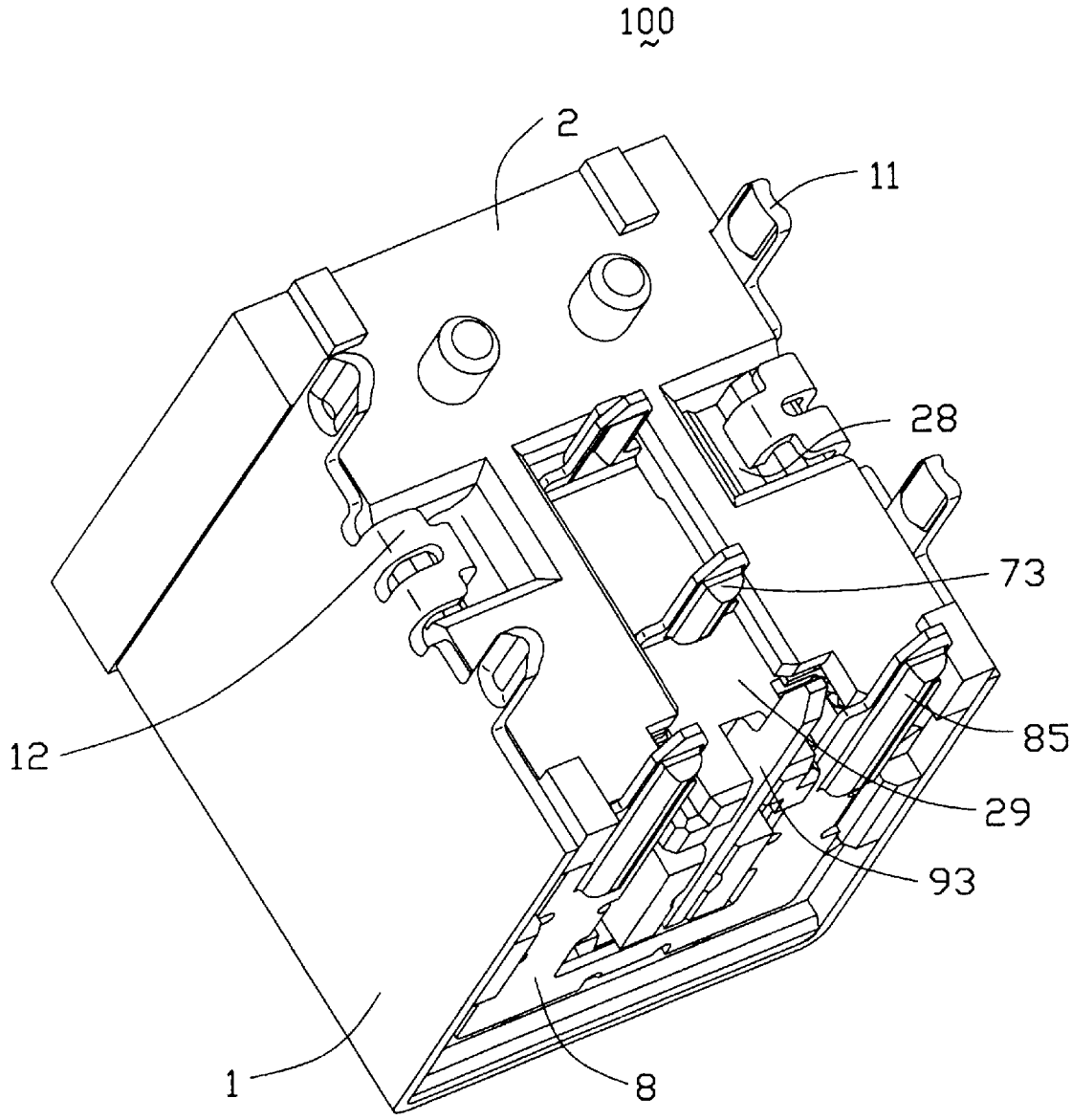
FIG. 9 is a perspective assembled view of the power connector of FIG. 1 from a bottom, rear aspect.

The insulative housing 2 is in the shape of a rectangular block. A rectangular key 211 is formed on a front portion (not labeled) of a top wall (not labeled) of the housing 2. An annular receiving space 3 is defined inwardly from a front face (not labeled) of the housing, creating a cylindrical inner portion 22 of the housing 2, which extends forward from a rear wall (not labeled) of the housing 2 and is bounded on its sides by the receiving space 3. A receiving hole 4 is defined along a longitudinal axis of the inner portion 22. Four first receiving slots 24 are defined in the housing 2 extending forwardly through the rear wall and roughly parallel to the top, a bottom, and two side walls of the housing 2, continuing into the outward surface of the inner portion 22. The first receiving slots 24 communicate with the receiving space 3. Four second receiving slots 25 are defined in four corners (not labeled) of the housing 2, extending forwardly through the rear wall of the housing 2 toward the front wall and communicating at their forward ends with the receiving space 3. A bottom slot 29 communicating with two lower second receiving slots 25 is defined on a bottom wall (not labeled) of the housing 2 (referring to FIG. 9). A center slot 26 coincident with the receiving hole 4 is defined through the rear wall and into the inner portion 22. A top groove 23 is defined in the rear wall immediately beneath the top wall, and a pair of side grooves 27 is defined in the rear wall adjacent opposite side walls.

The set of conductive first contacts 200 comprises four first mating contacts 5 and a first soldering contact 8. The set of conductive second contacts 300 comprises four second mating contacts 6 and a second soldering contact 7. Each first mating contact 5 and second mating contact 6 comprises a body portion 52, 62, a retention portion 51, 61 extending from one end of the body portion 51, 61, and a mating portion 53, 63 extending from the other end of the body portion 52, 62. A plurality of barbs 510, 560 is formed on a pair of edges of the retention portion 51, 61.

The first soldering contact 8 has the shape of an inverted "U" and comprises a transverse beam 81 and a pair of legs 82 extending downwardly from opposite ends of the beam 81. An upper retention portion 811 extends forwardly from the middle of the beam 81. An inner retention portion 83 and an outer retention portion 84 extend forwardly from a corresponding side edge of each leg 82. A pair of tabs 830 protrudes inwardly toward each other from corresponding, opposing inner retention portions 83. A plurality of barbs 841 is formed on each outer retention portion 84 and on the upper retention portion 811. A long slot 821 is defined in a mid-to-lower portion (not labeled) of each leg 82 and a soldering foot 85 forms a lower end of each leg 82.

The second soldering contact 7 comprises a base portion 71 with barbs 710 on opposite side edges thereof, a pair of arms 72 extending upwardly and outwardly from opposite sides of the base portion 71, and a soldering foot 73 extending downwardly from each of a front and rear edges of the base portion 71. Each arm 72 forms a tab 720 extending upwardly from an outer edge thereof.

The conductive signal pin 9 comprises a mating portion 91 having a tuning-fork shape and a mounting portion 93 extending downwardly from a rearward end of the mating portion 91. A plurality of barbs 92 is formed on the upper and lower edges of the mating portion 91.

The conductive shield 1 has the shape of an inverted "U" and defines a cutout 13 at a front of a top wall (not labeled) thereof. A pair of soldering feet 11 extend downwardly from a lower edge (not labeled) of each of two opposite side walls (not labeled). A locking tab 12 extends inwardly and upwardly from the lower edge of each sidewall of the conductive shield 1.

Figure 4:
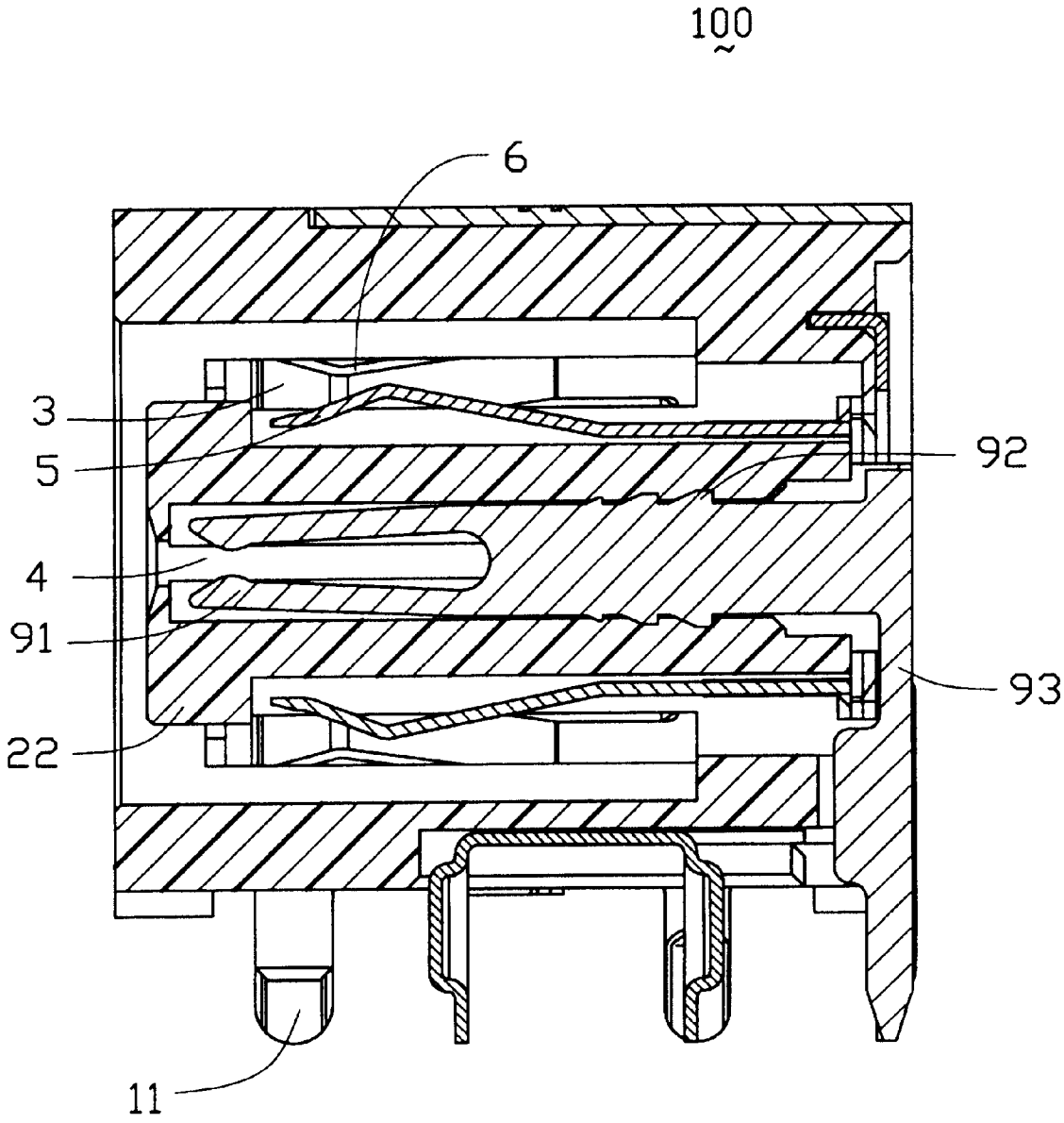
FIG. 4 is a cross sectional view of the power connector taken along line 4-4 of FIG. 1.

The first mating contacts 5 act as a positive pole of a power supply while the second mating contacts 6 act as a negative pole. Now referring to FIGS. 3 and 4, in assembly, the first mating contacts 5 first protrude through the first receiving slots 24 and finally are assembled on the outward surface of the inner portion 22. The retention portions 51 lock into the first receiving slots 24 respectively through the barbs 510 thereon. The body portions 52 and mating portions 53 are received in the first receiving slots 24 locating on the outward surface of the inner portion 22. The second mating contacts 6 first protrude through the second receiving slots 25 and finally are assembled in the four corners of the housing 2. The retention portions 61 lock into the second receiving slots 25 respectively through the barbs 610 thereon. The body portions 62 and mating portions 63 are received in the second receiving slots 25 the mating portions 53, 63 of the first and second mating contacts 5, 6 are partly exposed into the receiving space 3 to mate with the mating connector (not shown). The mating portions 53 of the first mating contacts 5 bend outwardly and protrude from the first receiving slots 24 into the receiving cavity 3, while the mating portions 63 of the second mating contacts 6 bend inwardly and protrude from the second receiving slots 25 into the receiving cavity 3.

Referring to FIGS. 3 to 9, the conductive signal pin 9 is inserted into the insulative housing 2 from the rear end thereof. The mating portions 91 is received in the receiving hole 4 and the barbs 92 formed thereon interfere to the receiving hole 4. The mounting portion 93 is received into the center slot 26 coincident with the receiving hole 4 for being mounted to the printed circuit board (not shown). The conductive shield 1 encloses the insulative housing 2 and the pair of locking tabs 12 lock into slots 28 on the bottom wall of the housing 2 (referring to FIG. 9). The cutout 13 of the conductive shield 1 engages with the key 211 of the housing 2.

Figure 5:
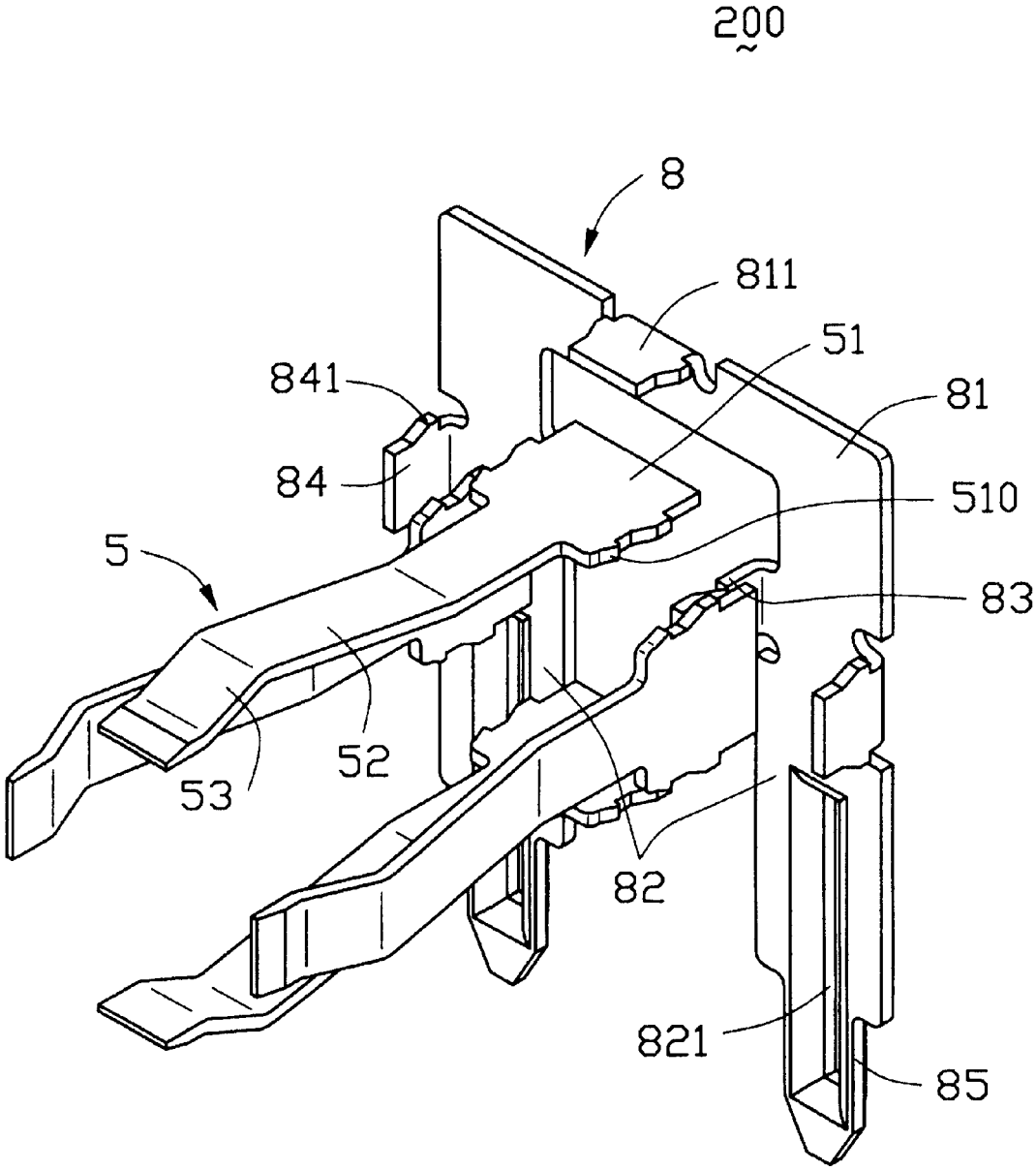
FIG. 5 is a perspective view of first mating contacts and a first soldering contact of FIG. 2.
Figure 6:
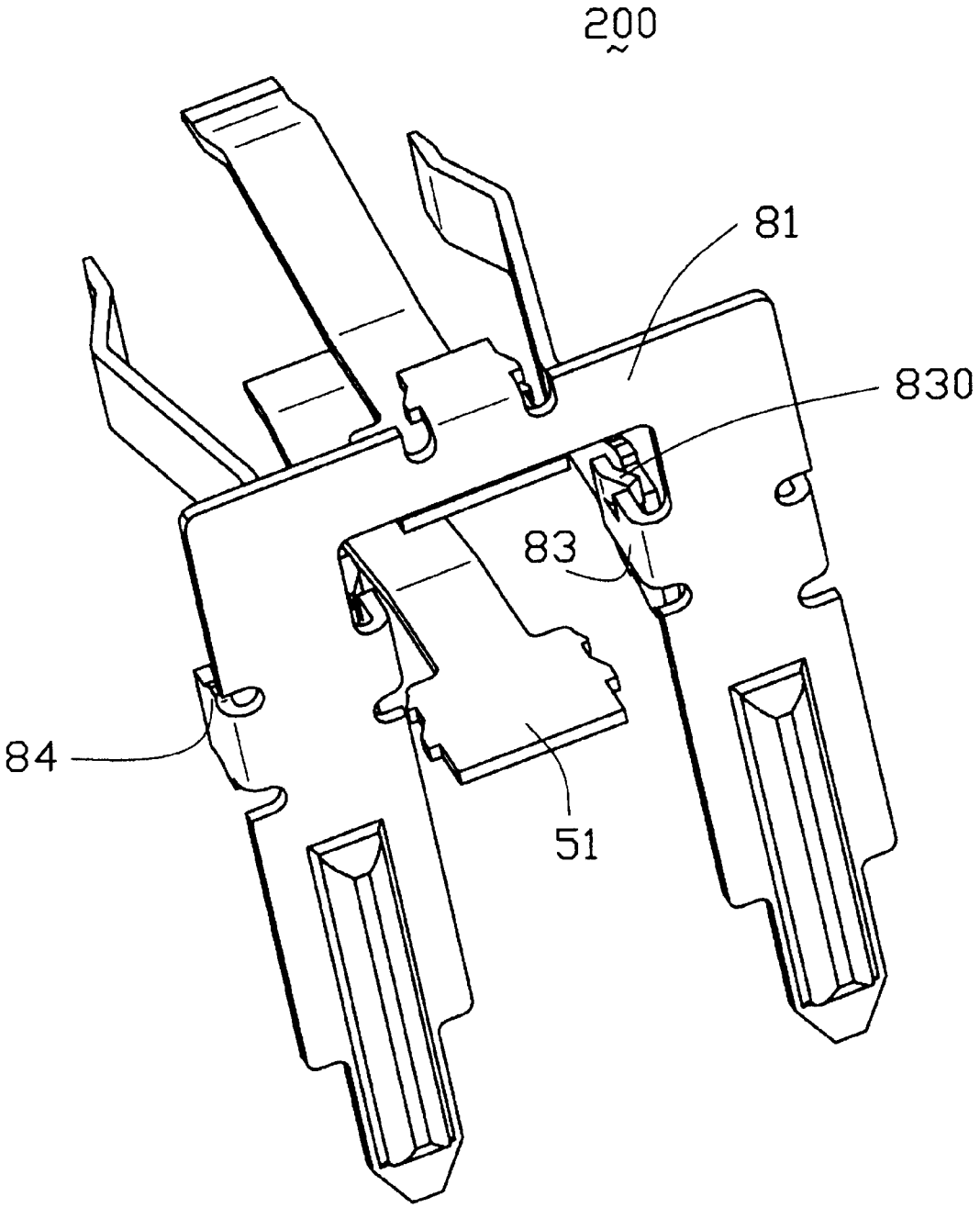
FIG. 6 is a perspective view of the first mating contacts and the first soldering contact of FIG. 5 from another angle.

Referring to FIGS. 3, 5 and 6 which shows how the first soldering contact 8 contacts the first mating contacts 5. After the first soldering contact 8 inserted into the insulative housing 2 from the rear end thereof, the upper retention portion 811 extending from the middle of the transverse beam 81 is received and securely fixed in the top groove 23 through the barbs 841 thereon. The pair of inner retention portions 83 is assembled into the first receiving slots 24. The pair of outer retention portions 84 is assembled into the side grooves 27 and securely fixed to the side grooves 27 through the barbs 841. Each tab 830 of the inner retention portions 83 resiliently presses against a corresponding first mating contact 5, forming an electrical connection between the first mating contacts 5 and the first soldering contact 8. The soldering feet 85 are used for being mounted to the printed circuit board (not shown).

Figure 7:
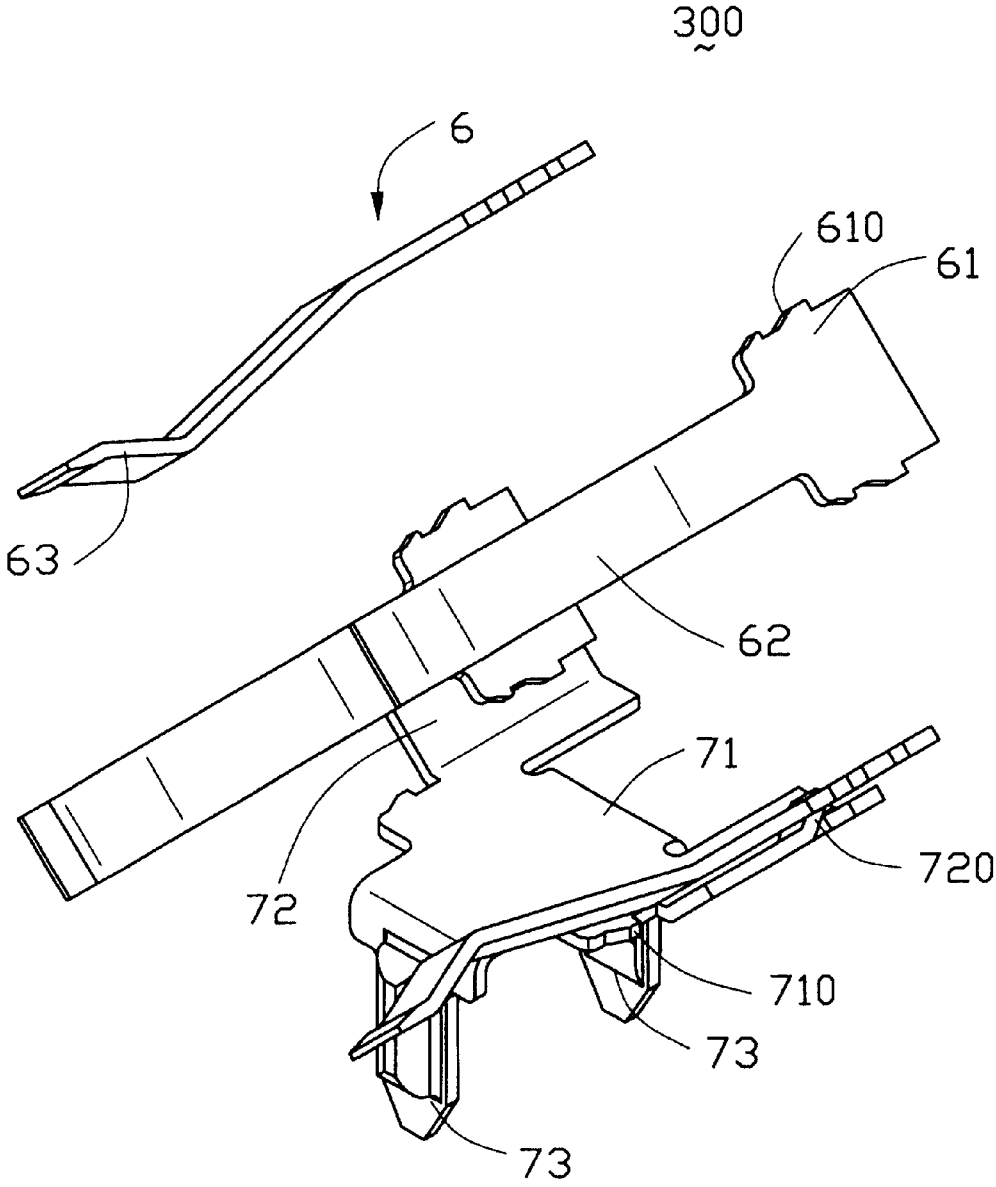
FIG. 7 is a perspective view of second mating contacts and a second soldering contact of FIG. 2.
Figure 8:
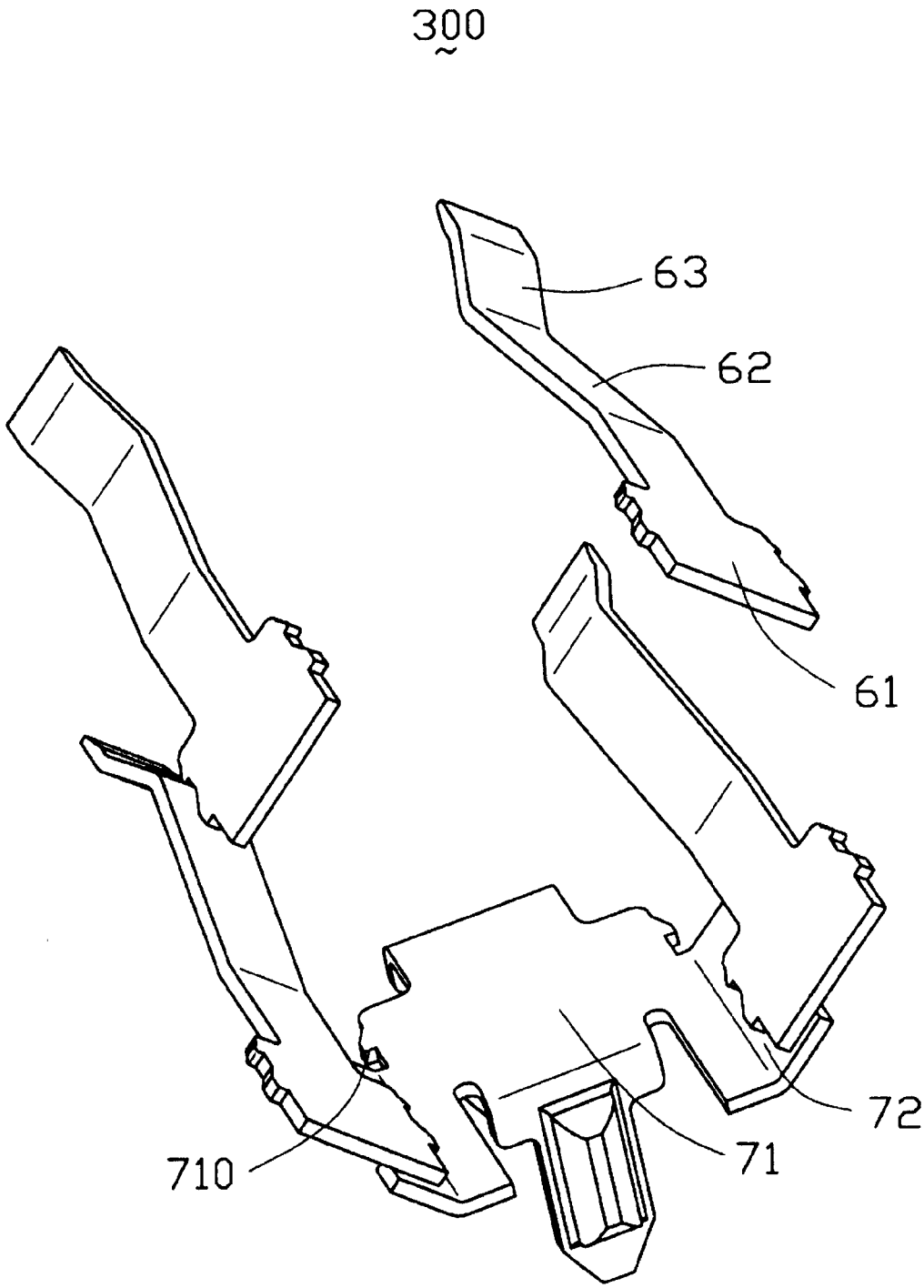
FIG. 8 is a perspective view of the second mating contacts and the second soldering contact of FIG. 7 from another angle.

Referring to FIGS. 3, 7 and 8 which disclose how the second soldering contact 7 contacts the second mating contacts 6. After the second soldering contact 7 assembled into the lower portion of the housing 2 from the rear end thereof, the base portion 71 is received into the bottom slot 29 communicating with the two lower second receiving slots 25 and engage with the bottom slot 29 through the barbs 710 thereon. The arms 72 is received into the two lower second receiving slots 25. Each tab 720 formed on the arms 72 resiliently presses against a corresponding second mating contact 6, forming an electrical connection between the second mating contacts 6 and the second soldering contact 7. The soldering feet 73 are also used for being mounted to the printed circuit board (not shown).

The first and second mating contacts 5, 6 of the power connector 100 each have four contacts and respectively act as the positive and negative poles of the power supply, and the first and second soldering contacts 8, 7 each has a pair of tabs 830, 720 to resiliently press against corresponding mating contacts 5, 6. Therefore the first and second mating contacts 5, 6 each have two contacts electrically mating with the mating connector (not shown), while the other two contacts of each first and second mating contacts 5, 6 only mechanically support the mating connector along the circumferential direction. In addition, the structure of each mating contact or soldering contact is relatively simple and thus will require a relatively inexpensive die. Moreover, the power connector in accordance with the present invention needs less amount of material so the cost cut down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector for being mounted to a printed circuit board, comprising:

an insulative housing comprising a receiving space defined inwardly from a front surface of the insulative housing and an inner portion extending from a rear wall of the housing and bounded on its sides by the receiving space;

a set of conductive first contacts comprising a plurality of first mating contacts and a discrete first soldering contact, the first mating contacts assembled in the inner portion and partly exposed in the receiving space, the first soldering portion assembled into the insulative housing and electrically contacting the first mating contacts;

a set of conductive second contacts comprising a plurality of second mating contacts and a discrete second soldering contact, the second mating contacts assembled in the insulative housing and partly exposed in the receiving space, the second soldering contact inserted into the insulative housing and mechanically and electrically contacting the second mating contacts.

2. The power connector as described in claim 1, wherein a receiving hole is defined along a longitudinal axis of the inner portion and coincident with a center slot defined through the rear wall and into the inner portion of the insulative housing.

3. The power connector as described in claim 2, wherein the power connector further comprises a conductive signal pin comprising a mating portion received in the receiving hole, a mounting portion extending downwardly from the end of the mating portion and received in the center slot coincident with the receiving hole for being mounted to the printed circuit board.

4. The power connector as described in claim 3, wherein said mating portion of the signal pin has a plurality of barbs thereon interfering to the receiving hole.

5. The power connector as described in claim 1, wherein the first mating contacts comprise four contacts which are assembled on the outward surface of the inner portion, each contact comprising a body portion, a retention portion extending from one end of the body portion, and a mating portion extending from the other end of the body portion.

6. The power connector as described in claim 1, wherein the second mating contacts comprise four contacts which are assembled in four corners of the insulative housing, each second mating contact comprising a body portion, a retention portion extending from one end of the body portion, and a mating portion extending from the other end of the body portion.

7. The power connector as described in claim 5, wherein the insulative housing defines four first receiving slots extending forwardly through the rear wall and roughly parallel to a top, a bottom, and two side walls of the housing, continuing into the outward surface of the inner portion of the housing, the four retention portions of the first mating contacts locking into the first receiving slots respectively through barbs thereon, the mating portions bending outwardly and protruding from the first receiving slots into the receiving cavity.

8. The power connector as described in claim 6, wherein the insulative housing defines four second receiving slots on the four corners of the rear wall thereof, the retention portions of the second mating contacts locking into the second receiving slots respectively through barbs thereon, the mating portions bending inwardly and protruding from the second receiving slots into the receiving cavity.

9. The power connector as described in claim 1, wherein the first soldering contact comprises a transverse beam, a pair of legs extending downwardly from a pair of ends of the beam for being mounted to the printed circuit board.

10. The power connector as described in claim 7, wherein a top groove is defined in the rear wall immediately beneath the top wall.

11. The power connector as described in claim 7, wherein a pair of side grooves is defined in the rear wall adjacent opposite side walls.

12. The power connector as described in claim 10, wherein an upper retention portion extending from the middle of the transverse beam is received and securely fixed in the top groove through barbs thereon.

13. The power connector as described in claim 11, wherein an inner retention portion and an outer retention portion extend forwardly from a corresponding side edge of each leg, the pair of inner retention portions is assembled into the first receiving slots, the pair of outer retention portions is assembled into the side grooves.

14. The power connector as described in claim 13, wherein a pair of tabs protrudes inwardly toward each other from corresponding, opposing inner retention portions, each tab resiliently presses against a corresponding first mating contact for forming an electrical connection between the first mating contacts and the first soldering contact.

15. The power connector as described in claim 1, wherein the second soldering portion comprises a base portion, a pair of arms extending upwardly and outwardly from opposite sides of the base portion, and a soldering foot extending downwardly from each of a front and rear edges of the base portion for being mounted to the printed circuit board.

16. The power connector as described in claim 15, wherein each arm forms a tab extending upwardly from an outer edge thereof, each tab resiliently pressing against a corresponding second mating contact for forming an electrical connection between the second mating contacts and the second soldering contact.

17. The power connector as described in claim 1, wherein the power connector further has a conductive shield enclosing the housing.

18. The power connector as described in claim 17, wherein the conductive shield further comprises a pair of lock tabs extending inwardly and upwardly from the lower edge of each sidewall thereof and respectively locking into slots on the bottom wall of the housing.

19. An electrical connector comprising:

an insulative housing defining a cylindrical inner portion with a signal contact therein;

an annular receiving space surrounding said inner portion;

first and second sets of contacts alternately disposed within the receiving space;

a discrete first solder contact mechanically and electrically engaged with at least some of said first set of contacts; and a discrete second solder contact spaced from said first solder contact and mechanically and electrically engaged with at least some of said second set of contacts.

20. The connector as described in claim 19, wherein others of said first set of contacts and others of said second set of contacts are only for mechanical use.

21. The connector as described in claim 19, wherein said first set of contacts are arranged in equal intervals.

22. The connector as described in claim 19, wherein said second set of contacts are arranged in equal intervals.

23. An electrical connector comprising:

an insulative housing defining a cylindrical inner portion with a signal contact therein;

an annular receiving space surrounding said inner portion; and first and second sets of contacts respectively characterized as positive and negative electrodes and disposed within the receiving space; wherein the first set of contacts are symmetrically arranged around an axis of said cylindrical inner portion, and the second set of contacts are symmetrically arranged around said axis.

24. The connector as described in claim 23, wherein some of said first set of contacts only provides a mechanical retention function for a complementary plug.

25. The connector as described in claim 23, wherein some of said second set of contacts only provides a mechanical retention function for a complementary plug.

* * * * *